US006460578B2

(12) United States Patent
Lindblom

(10) Patent No.: US 6,460,578 B2
(45) Date of Patent: Oct. 8, 2002

(54) BRAKE ARRANGEMENT FOR A NUMBER OF THREADS OF YARNS WHICH CAN BE FED IN OR TO A TEXTILE MACHINE

(75) Inventor: Bo Lindblom, Osby (SE)

(73) Assignee: Texo AB, Almhult ( * ) Notice: Subject to any disclaimer, the term of this patent is extended or adjusted under 35 U.S.C. 154(b) by 0 days.

(21) Appl. No.: 09/731,807

(22) Filed: Dec. 8, 2000

(65) Prior Publication Data

US 2001/0020492 A1 Sep. 13, 2001

(30) Foreign Application Priority Data

Dec. 8, 1999 (SE) ..... 99044677

(51) Int. Cl.[7] ..... D03D 41/00
(52) U.S. Cl. ..... 139/194; 139/452
(58) Field of Search ..... 139/194, 452

(56) References Cited

U.S. PATENT DOCUMENTS

| | | | | |
|---|---|---|---|---|
| 2,451,889 A | | 10/1948 | Toone | |
| 3,797,532 A | * | 3/1974 | Haltmeier | 139/194 |
| 3,929,169 A | * | 12/1975 | Pfarrwaller | 139/122 H |
| 4,175,307 A | * | 11/1979 | Altenweger | 28/211 |
| 4,186,898 A | | 2/1980 | Wilson et al. | |
| 4,467,841 A | * | 8/1984 | Zweiner | 139/429 |
| 4,875,506 A | * | 10/1989 | Gacsay et al. | 139/450 |
| 5,417,251 A | * | 5/1995 | Josefsson et al. | 139/450 |
| 5,483,997 A | * | 1/1996 | Corain et al. | 139/194 |

FOREIGN PATENT DOCUMENTS

| | | |
|---|---|---|
| DE | 30 29 793 | 2/1981 |
| EP | 294 323 | 5/1988 |
| SE | 7906397-0 | 6/1986 |
| WO | WO 97/49850 | 12/1997 |

* cited by examiner

*Primary Examiner*—A Vanatta
*Assistant Examiner*—Robert H. Muromoto, Jr.
(74) *Attorney, Agent, or Firm*—Connolly Bove Lodge & Hutz LLP; Larry J. Hume

(57) ABSTRACT

A brake arrangement is intended for or can be assigned. to a number of threads or yarns which can be fed in or to a textile machine, for example a weaving machine. The brake arrangement comprises two units (1,2) which have thread or yarn parts (11, 12, 13, 14, 15, 16, 17) lying between them and which are pressed towards each other by actuating members (3, 4, 5, 6 and 7, 8, 9, 10, respectively), which units (1, 2) cooperate with the thread or yarn parts via two opposite surfaces (1*a* and 2*a*, respectively) which are made of smooth material and are set substantially parallel by the cooperation with the thread or yarn parts. The actuating member is arranged to exert, via the unit, press forces (F) on the thread or yarn parts which are substantially identical, on the one hand, on the different thread or yarn parts and, on the other hand, along at least part of the length of the respective thread or yarn part.

24 Claims, 4 Drawing Sheets

BRAKE ARRANGEMENT FOR A NUMBER OF THREADS OF YARNS WHICH CAN BE FED IN OR TO A TEXTILE MACHINE

TECHNICAL FIELD

The present invention relates to a brake arrangement intended for a number of threads or yarns which can be fed in or to a textile machine. One example of a textile machine which may be mentioned is a weaving machine, and for further examples reference may be made to the TM 300 and TM 400 machines sold commercially by TEXO AB, Sweden. The feed threads or yarns are assumed to have substantially identical diameters.

1. Prior Art

Brake arrangements for different types of threads and yarns for use in textile machines are already well known. For example, it is already known to use brake arrangements with plates or the like pressed against each other and with a thread or a yarn lying between them, the press force of these plates thus being used to determine the braking speed. Reference may be made here to what is generally known in the field of textile machines and thread control wheels. The brake arrangement is intended to be able to define, inter alia, the thread or yarn tensioning in the threads or yarns leaving the brake arrangement.

2. Disclosure of the Invention

TECHNICAL PROBLEM

In various situations there is a need to be able to exert a braking action on a number of parallel weft or warp threads, yarns, etc. In this regard, it is essential that the effected braking force is identical on all the threads so that some threads are not braked more strongly than others, or vice versa. The aim of the invention is to solve this problem among others.

It is also important that the brake can be designed with technically simple means and that it is still technically reliable. In connection with brakes of this type, there is in some cases a further requirement of being able to vary the braking force in steps or continuously and, if appropriate, for this to be controlled from a superior or subordinate control unit in the actual machine. Moreover, the brake arrangement should not exert inappropriate stresses on the threads or yarns resulting in damage or discolouring of the latter. The brake arrangement must therefore be gentle on the threads or yarns involved. The invention aims to solve this set of problems too.

SOLUTION

The feature which can principally be regarded as characterizing the novel brake arrangement is that it comprises two units which have thread or yarn parts lying between them and which are pressed towards each other by actuating members, which units cooperate with the thread or yarn parts via two surfaces made of smooth material, situated or directed opposite each other and set substantially parallel by the cooperation with the thread or yarn parts. A further feature of the subject of the invention is that the actuating member or actuating members is (are) arranged to exert, via the units, press forces on the thread or yarn parts which are substantially identical, on the one hand, on the different thread or yarn parts and, on the other hand, along at least part of the length of the respective thread or yarn part.

In one illustrative embodiment of the concept of the invention, the unit consists of or comprises two glass panels.

Alternatively, the units can be made of smooth plastic material, for example polyethylene. In one illustrative embodiment, the opposing surfaces can have depressions or grooves extending in the longitudinal direction of the thread or yarn parts. At the inlet opening to the brake arrangement, the units are preferably provided with bevels in the material in order to prevent the threads or yarns being cut into. The threads or yarns can also be provided with a smooth outer surface. The actuating member can be made adjustable in order to obtain various desired press forces for the thread or yarn parts. In one embodiment, the actuating member can consist of or comprise permanent magnets applied on the outside of both units, from which the units obtain magnetic holding forces which generate the said press forces on the thread or yarn parts. In a further embodiment, the actuating member can consist of or comprise electromagnets, which can be controlled by electric signals for obtaining different press force levels. In a further illustrative embodiment, the actuating member can comprise mechanical weights, springs, etc., which effect the said pressing forces.

ADVANTAGES

By means of what has been proposed above, an economically advantageous brake arrangement is obtained which can be mass-produced and used widely in the textile industry. In one embodiment, the brake arrangement is made especially simple and can be designed, for example, with glass panels and permanent magnets, the number of which determines the brake force exerted or the press forces exerted. The panels thus consist of smooth material which from the point of view of slide is compatible with the outer material of the threads or yarns which in this case, as it consists of or comprises plastic material, results in an advantageous drawing-through and braking function in the brake arrangement. The units can, if appropriate, be assigned a cooling function which reduces the temperature at high run-through speeds of the threads or yarns.

The novel arrangement can function as a thread-tensioning or yarn-tensioning member for the thread or yarn parts issuing from the brake arrangement in question, in which case the thread or yarn tensions can be determined with great precision and can in addition be varied if so desired.

DESCRIPTION OF THE FIGURES

Presently proposed embodiments of a brake arrangement according to the invention will be described below with reference to the attached drawing, in which.

DETAILED EMBODIMENT

Figure 1:
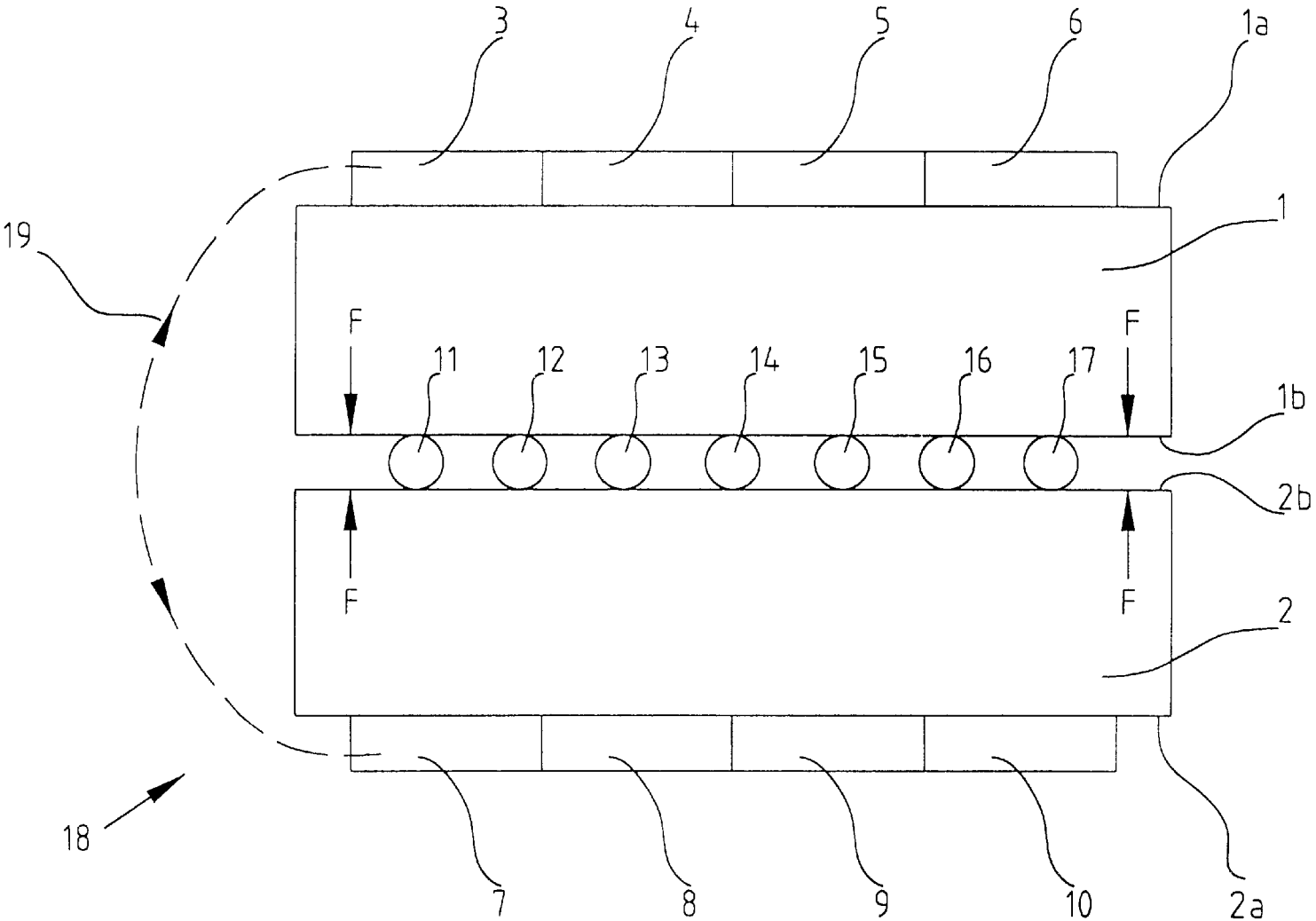
FIG. 1 shows a side view of a brake arrangement consisting of two units which between them press a number of threads or yarns and where the press forces are exerted by permanent magnets.

In FIG. 1, two units arranged one on top of the other are indicated by 1 and 2. In one embodiment, the units are made of glass and the units thus form glass panels. On top of the unit 1, i.e. on the upper surface 1*a* of the unit 1, there are a number of permanent magnets 3, 4, 5, 6. A corresponding number of permanent magnets 7, 8, 9 and 10 are arranged on the bottom surface 2*a* of the unit 2. Thread or yarn parts 11, 12, 13, 14, 15, 16 and 17 run between the units. The number of thread or yarn parts can vary, and although the invention in principle functions for only two threads or yarns, it is assumed in the illustrative embodiment that a greater number than two thread or yarn parts will run through the brake arrangement, which has been indicated in general by 18. The panels 1 and 2 are pressed towards each other by means of a magnetic force which is generated by the permanent magnets and has been symbolized by 19 in the figure. The units bear against the thread or yarn parts via the surfaces 1*b* and 2*b*, respectively. A characteristic of the arrangement is that the units 1 and 2 are pressed uniformly against the thread or yarn parts by the magnetic force 19. This means that the surfaces 1*b* and 2*b* are substantially parallel and that the forces F in the units 1 and 2 assume substantially identical values. A further characteristic of the arrangement according to FIG. 1 is that the press forces exerted by the units 1 and 2 against the thread or yarn parts are substantially identical in or on the different thread or yarn parts. Any irregularities in the thread or yarn parts are assumed to be substantially evened out by sufficient press force by means of the magnetic field 19.

Figure 2:
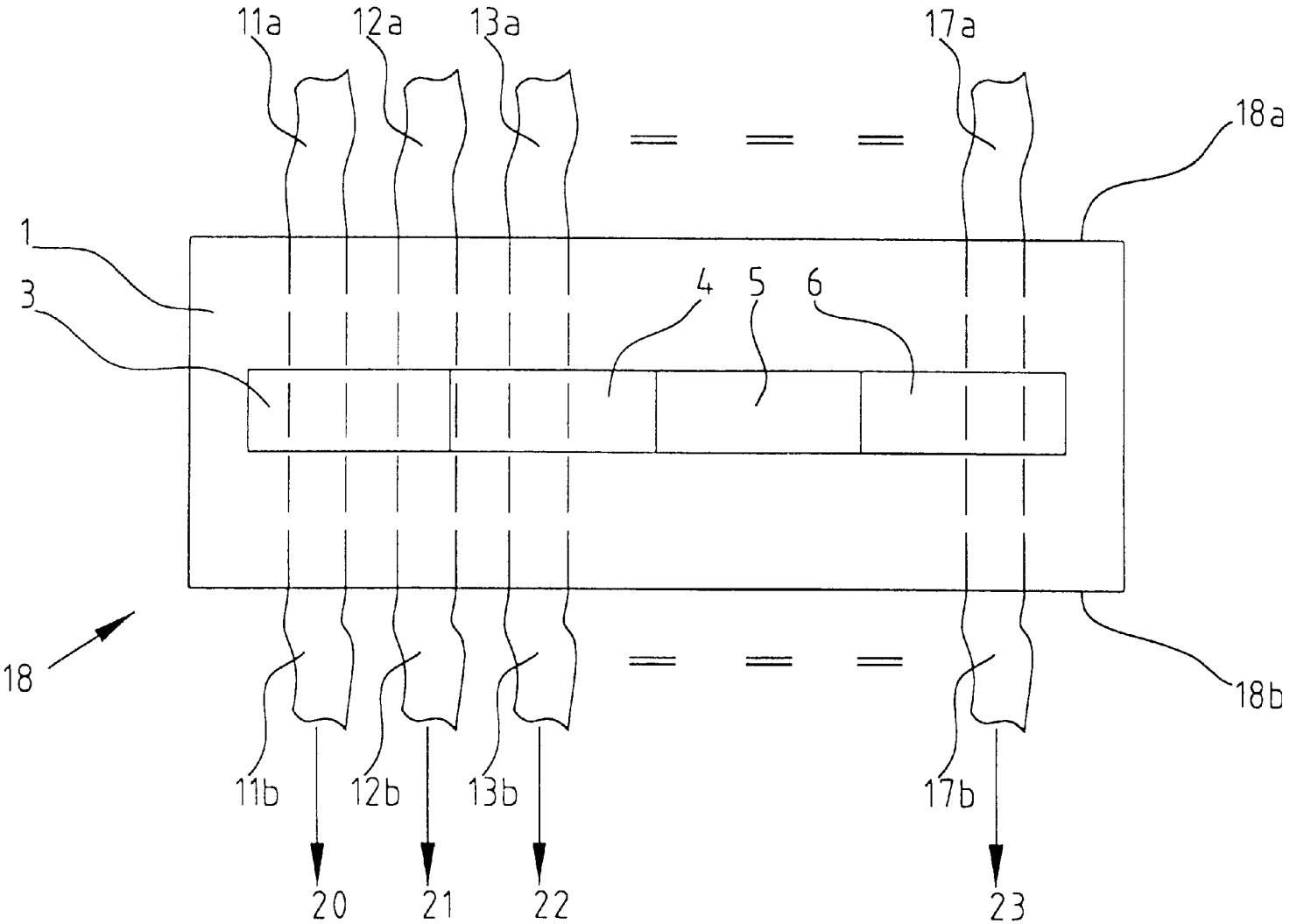
FIG. 2 shows a horizontal view of the embodiment in FIG. 1.

FIG. 2 shows the arrangement according to FIG. 1 from above, and it will be seen that the number of permanent magnets 3, 4, 5 and 6 can be varied in number and size in order to exert different levels of press forces F (cf. FIG. 1). In FIG. 2, the feed directions for the thread or yarn parts are indicated by 20, 21, 22 and 23, respectively. It will also be seen from FIG. 2 that the thread parts 11*a*, 12*a*, 13*a* and 17*a* can be slackened (at least slightly) at the inlet opening 18*a* of the brake arrangement. The thread or yarn parts leaving at the outlet opening 18*b* of the brake. arrangement can be stretched as they are drawn out of the brake arrangement 18 with thread tensions which are determined by the brake function. By means of the invention, a thread tensioning can thus be obtained in the said issuing thread or yarn parts. The thread tensioning is thus determined by means of the press force exerted on the units by the permanent magnets. In FIG. 2, however, the outgoing parts have been shown slackened in order to indicate a rest condition of the brake arrangement.

Figure 3:
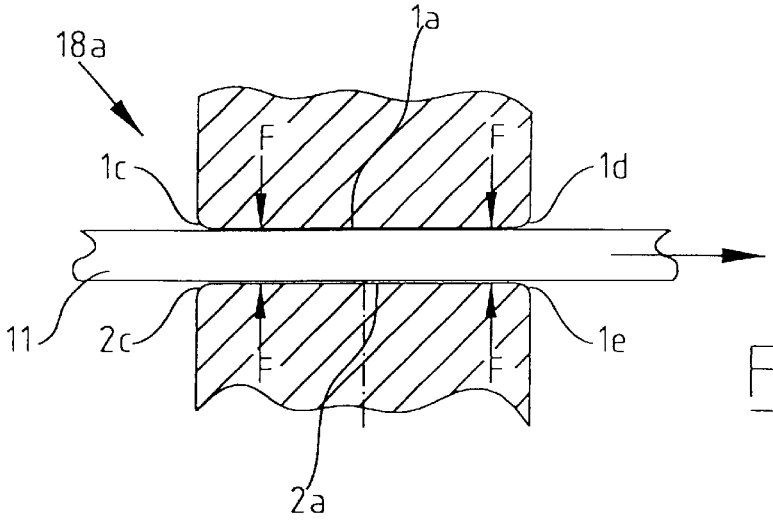
FIG. 3 shows a longitudinal section through parts of the units according to FIG. 1 and a thread part situated between the units.

In accordance with FIG. 3, another characteristic feature of the invention is that the effect exerted by the units 1 and 2 on the thread or yarn part situated between the surfaces of the units will be uniform along the entire length thereof, i.e. the press forces F at the inlet and outlet openings 18*a* and 18*b* will be substantially identical. At the inlet opening, the units are provided with bevels 1*c* and 2*c* for safeguarding the threads or yarns at the end opening in the brake arrangement. Corresponding bevels 1*d* and 1*e* can also be arranged at the outlet opening 18*b*. In FIG. 3, the surfaces 1*a* and 2*a* cooperate with the thread or yarn part along most of the length of the thread part or yarn part. Of course, the extents of the surfaces 1*a* and 2*a* can be varied, but it is important that the said surfaces 1*a* and 2*a* have extents which guarantee that no unwanted damage or discoloring occurs on the thread parts.

Figure 4:
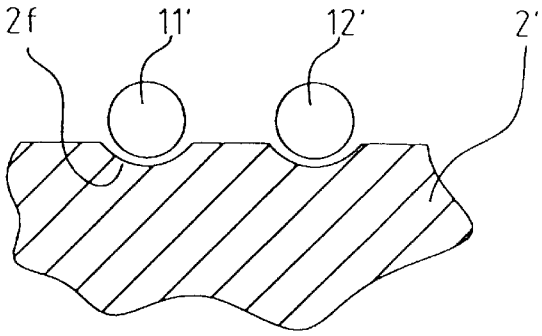
FIG. 4 shows in vertical section parts of an alternative embodiment compared with FIG. 1, in which alternative embodiment the unit has been provided, on its surface cooperating with the threads or yarns, with depressions or grooves extending in the direction of feed of the threads or yarns.

Parts of the lower unit have been shown in FIG. 4, the lower unit having been designated by 2'. The unit in question has been provided with grooves or depressions 2*f* which extend in the longitudinal direction of the thread or yarn parts. The upper unit too can be provided with such depressions. By means of this configuration, the thread or yarn parts 11', 12' are fixed in the sideways direction.

Figure 5:
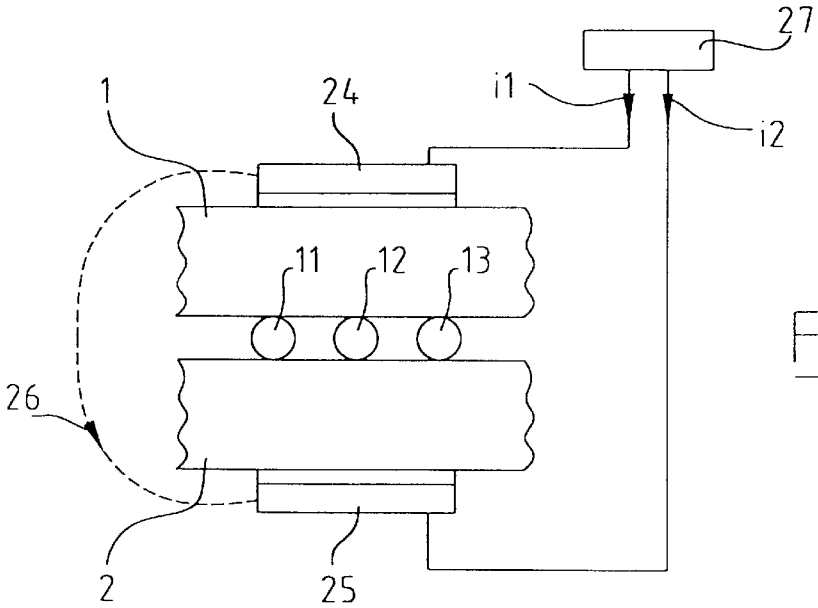
FIG. 5 shows in a side view, and in block diagram form, magnetic retention forces for the units, which forces have been generated with the aid of electromagnets which can be controlled from a control unit.

FIG. 5 shows how the actuating forces on the units 1 and 2 and the press forces on the thread or yarn parts 11, 12 and 13 are obtained with the aid of electromagnets 24, 25. The magnetic field is symbolized by 26. The electromagnets can be actuated from a control unit 27 belonging to the textile machine or weaving machine. Depending on manual signals supplied, or signals generated in the control unit, control signals are sent to the electromagnets, which control signals are shown in FIG. 5 as i1 and i2, respectively. It will be appreciated that the said actuating. and press forces can be varied within wide limits. Other possible ways of obtaining the said actuating forces on the units 1 and 2 can include weights, springs, etc.

Figure 6:
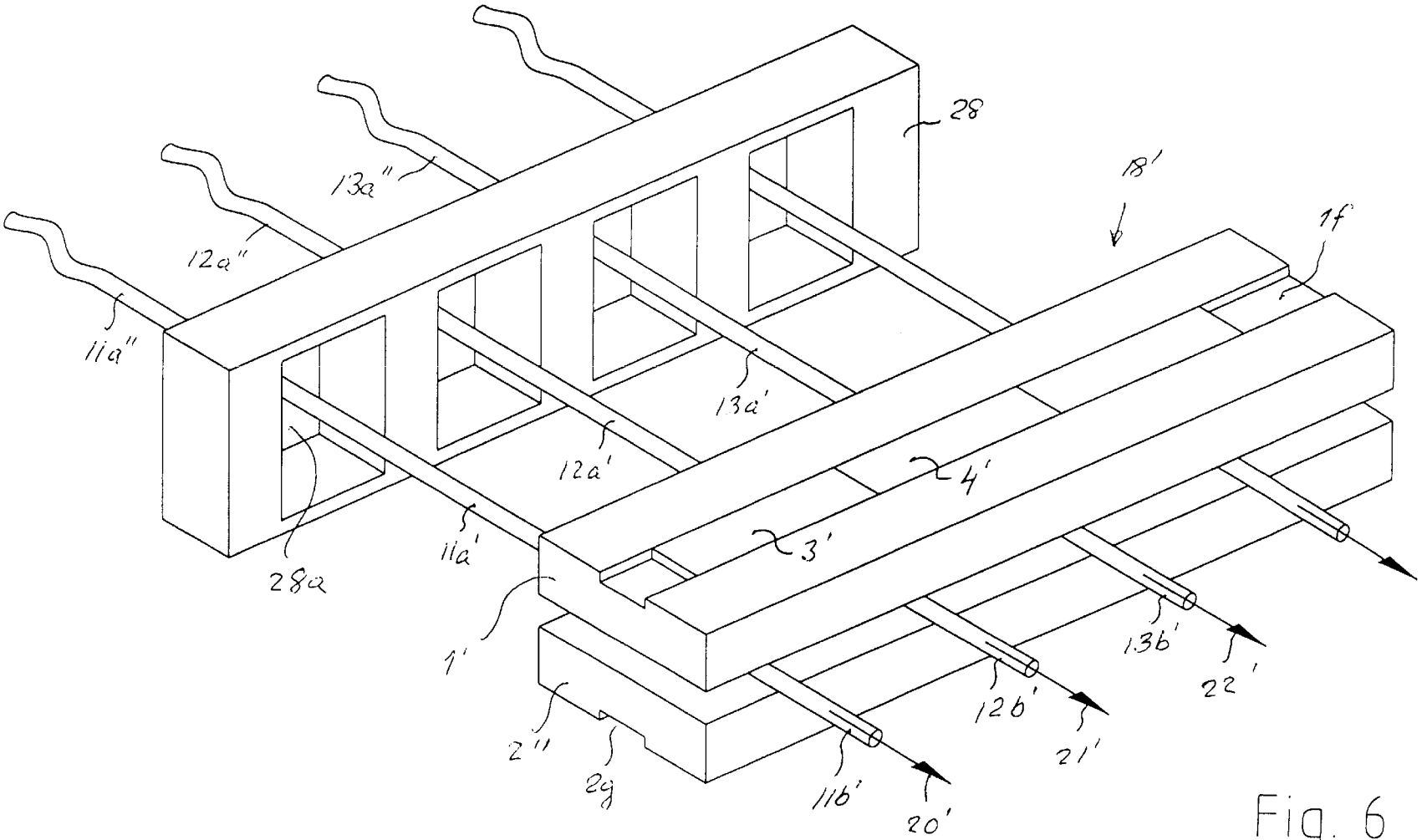
FIG. 6 shows in a perspective view, obliquely from above and from the left, the brake arrangement connected to a partly shown reed which is included in the textile machine or weaving machine.

In FIG. 6, the brake arrangement 18' is shown connected to a symbolically indicated reed 28, which can be of a known type. The reed is provided with guide openings 28*a* for the threads or yarns 11*a*', 11*a*", 11*b*' and 12*a*', 12*a*", 12*b*', and 13*a*', 13*a*", 13*b*', etc. The draw directions are shown by arrows 20', 21', 22', etc. The parts 1' and 2" of the brake arrangement are in this case provided with grooves or depressions 1*f*, 2*g* for the permanent magnets 3', 4'.

the invention is not limited to the embodiment described above by way of example, and instead it can be modified within the scope of the attached patent claims and the inventive concept.

What is claimed is:

1. Brake arrangement intended for a number of threads or yarns which can be fed in or to a textile machine, wherein the brake arrangement comprises two units which have thread or yarn parts lying between the units and where the units are pressed towards each other by actuating members, the units cooperate with the thread or yarn parts via two opposite surfaces which are made of smooth material and are set substantially parallel by the cooperation with the thread or yarn parts, and in that the actuating members are arranged to exert, via the units, press forces on the thread or yarn parts which are substantially identical on the different thread or yarn parts and along at least part of the length of the respective thread or yarn part.

2. Brake arrangement according to claim 1, wherein the units comprise two glass panels.

3. Brake arrangement according to claim 1, wherein the unit comprises smooth plastic material.

4. Brake arrangement according to claim 1, wherein the opposing surfaces have depressions for extending in the longitudinal direction of the thread or yarn parts.

5. Brake arrangement according to claim 1, wherein the units are arranged with bevels to prevent cutting into the threads or yarns.

6. Brake arrangement according to claim 1, wherein the threads or yarns comprise smooth outer surfaces.

7. Brake arrangement according to claim 1, wherein the actuating member may be adjusted in order to obtain the desired force against the thread or yarn parts.

8. Brake arrangement according to claim 1, wherein the actuating member comprises permanent magnets applied on the outside of each unit, from which the units obtain a magnetic holding force.

9. Brake arrangement according to claim 1, wherein the actuating member comprises electromagnets, controlled by electrical signals for obtaining different levels of actuating force.

10. Brake arrangement according to claim 1, wherein the actuating member comprises mechanical components effecting the pressing force.

11. Brake arrangement according to claim 1, wherein the brake arrangement functions as a thread-tensioning arrangement.

12. Brake arrangement according to claim 2, wherein the opposing surfaces have depressions extending in the longitudinal direction of the thread or yarn parts.

13. Brake arrangement according to claim 3, wherein the opposing surfaces have depressions extending in the longitudinal direction of the thread or yarn parts.

14. Brake arrangement according to claim 2, wherein for the thread or yarn parts, the units are arranged with bevels to prevent cutting into the threads or yarns.

15. Brake arrangement according to claim 3, wherein for the thread or yarn parts, the units are arranged with bevels to prevent cutting into the threads or yarns.

16. Brake arrangement according to claim 4, wherein for the thread or yarn parts, the units are arranged with bevels to prevent cutting into the threads or yarns.

17. Brake arrangement according to claim 2, wherein the threads or yarns are provided with or comprise smooth outer surfaces.

18. Brake arrangement according to claim 3, wherein the threads or yarns are provided with or comprise smooth outer surfaces.

19. Brake arrangement according to claim 4, wherein the threads or yarns are provided with or comprise smooth outer surfaces.

20. Brake arrangement according to claim 5, wherein the threads or yarns are provided with or comprise smooth outer surfaces.

21. Brake arrangement according to claim 1, wherein the textile machine is a weaving machine.

22. Brake arrangement according to claim 1, wherein the unit comprises polyethylene.

23. Brake arrangement intended for a thread or yarn which can be fed in or to a textile machine, wherein the brake arrangement comprises two units which have the thread or yarn part lying therebetween and where the units are pressed towards each other by actuating members, the units cooperate with the thread or yarn part via two opposite surfaces which are made of smooth material and are set substantially parallel by the cooperation with the thread or yarn part, and in that the actuating members are arranged to exert, via the units, press forces on the thread or yarn part which are substantially identical on the thread or yarn part and along at least part of the length of the respective thread or yarn part.

24. Brake arrangement intended for a number of threads or yarns which can be fed in or to a textile machine, wherein the brake arrangement comprises two units which have thread or yarn parts lying between the units and where at least one unit is pressed towards the other unit by an actuating member, the units cooperate with the thread or yarn parts via two opposite surfaces which are made of smooth material and are set substantially parallel by the cooperation with the thread or yarn parts, and in that the actuating member is arranged to exert, via the at least one unit, a press force on the thread or yarn parts which is substantially identical on the different thread or yarn parts and along at least part of the length of the respective thread or yarn part.

* * * * *

UNITED STATES PATENT AND TRADEMARK OFFICE

CERTIFICATE OF CORRECTION

PATENT NO. : 6,460,578 B2
DATED : October 8, 2002
INVENTOR(S) : Bo Lindblom

It is certified that error appears in the above-identified patent and that said Letters Patent is hereby corrected as shown below:

Title page,
Item [73], should read -- [73] Assignee: Texo AB, Almhult (SE) --

Signed and Sealed this

Fourth Day of February, 2003

JAMES E. ROGAN
*Director of the United States Patent and Trademark Office*